United States Patent [19]

Colodney et al.

[11] Patent Number: 4,576,738

[45] Date of Patent: Mar. 18, 1986

[54] HARD SURFACE CLEANING COMPOSITIONS CONTAINING PIANANE

[75] Inventors: Daniel Colodney; Robert J. Steltenkamp, both of Somerset, N.J.

[73] Assignee: Colgate-Palmolive Company, New York, N.Y.

[21] Appl. No.: 684,653

[22] Filed: Dec. 21, 1984

[51] Int. Cl.[4] ..... C11D 1/83; C11D 3/44

[52] U.S. Cl. ..... 252/559; 252/170; 252/171; 252/535; 252/539; 252/540; 252/558; 252/546; 252/DIG. 14

[58] Field of Search ..... 252/170, 171, 559, 540, 252/DIG. 14, 546, 174.19, 554, 535, 558

[56] References Cited

U.S. PATENT DOCUMENTS 3,658,708 4/1972 Ratto ..... 252/170 X
3,929,680 12/1975 Arai et al. ..... 252/542
3,933,674 1/1976 Farnsworth ..... 252/171
4,310,714 1/1982 Pavlin ..... 585/275
4,414,128 11/1983 Goffinet ..... 252/111

FOREIGN PATENT DOCUMENTS 80749 6/1983 European Pat. Off. .

*Primary Examiner*—Prince E. Willis
*Attorney, Agent, or Firm*—Richard N. Miller; Murray M. Grill; Herbert S. Sylvester

[57] ABSTRACT

A hard surface cleaning composition containing a binary solvent system comprising a saturated terpene hydrocarbon and a non-aqueous polar solvent in combination with surfactants and builder salts. The binary system provides synergistic cleaning action for removal of greasy soil from porous and non-porous hard surfaces.

12 Claims, No Drawings

HARD SURFACE CLEANING COMPOSITIONS CONTAINING PIANANE

BACKGROUND OF THE INVENTION

The use of modern, easy-to-clean, prefabricated kitchen, bathroom, and cellar furnishings, furniture with plastic veneer, and the increasing use of freezer chests, refrigerators, washers and dishwashers, that is, household appliances with enameled metal walls with large surfaces, have led to a steep increase in the demand for all-purpose liquid cleaners in the household.

General purpose or all-purpose household cleaning compositions for hard surfaces such as metal, glass, ceramic, plastic, and linoleum surfaces have been sold commercially in both powdered and liquid form. The powdered compositions consist mainly of builders and buffering salts such as phosphates, carbonates, silicates, and the like and these compositions are diluted with water prior to use. While use concentrations of such compositions usually provide good inorganic soil removal, they tend to be deficient in removal of organic soils such as the greasy/fatty/oily soils typically found in the domestic environment.

On the other hand, all-purpose liquid cleaners have met with greater commercial acceptance because they have the advantage that they can be applied to hard surfaces in neat or concentrated form so that a relatively high level of surfactant material is delivered directly to the soils. Furthermore, it is easier to incorporate high concentrations of anionic or nonionic surfactant in a liquid rather than in a powdered composition. Because of these two significant advantages, much research and development effort has been expended on formulating all-purpose liquid cleaning compositions which are stable upon storage, have good physical properties and are effective in removing inorganic and organic soils.

Liquid hard surface cleaners generally have been classified into two types. The first type is a particulate aqueous suspension having water-insoluble abrasive particles suspended therein, which particles are palpable. Some of the cleaners of this type suffer a stability problem and other cleaners of this type have received poor acceptance by consumers because of their "gritty" feel which causes many people to be reluctant to use them for fear of scratching the surface to be cleaned. The second type is the liquid detergent without suspended abrasive and, seemingly, this latter type is preferred by consumers. While this second type generally is a mixture of surfactant and builder salt in an aqueous medium, the product formulations in the market place have varied widely in composition.

One liquid product which achieved some success was based upon a mixture of soap, alkylbenzene sulfonate and fatty acid alkanolamine plus inorganic builder salts. Such liquid exhibited good temperature stability and a desirable viscosity, but tended to exhibit cleaning disadvantages as compared with another product based upon a mixture of alkylbenzene sulfonate and ethoxylated alkanol plus builder salts. However, the latter composition usually requires a high concentration of a lower alkylbenzene sulfonate hydrotrope in order to achieve homogeneity in the presence of builder salts and the inclusion of hydrotrope resulted in lower viscosity and the need for thickening agents.

Other all-purpose liquid products were prepared which incorporated a solvent, such as a terpene. For example, German Patent Application No. 21 13 732 discloses the use of terpenes as anti-microbial agents in washing compositions. British Pat. No. 1,308,190 teaches the use of dipentenes in a thixotropic liquid detergent suspension based composition. German Patent Application No. 27 09 690 teaches the use of pine oil, a mixture of largely terpene alcohols, in liquid hard surface cleaning compositions. U.S. Pat. No. 4,414,128 teaches the use of terpenes with solvents of limited water solubility such as benzyl alcohol in all-purpose cleaning compositions. The terpenes are used to provide cleaning as well as to control sudsing. A similar composition is disclosed in European Patent Application No. 0080749 which comprises surfactant, terpenes, butyl carbitol and builder salts. Again, the terpenes are included for cleaning and as suds regulators.

Despite the extensive efforts in formulating all-purpose liquid cleaning compositions, there is still a need for a liquid product with effective cleaning properties, particularly in removal of grease and oily soil when applied neat. Also, such products should be effective at varying water hardness levels, should have desirable foaming characteristics and should leave little or no spots or streaks when rinsed or not. Furthermore, the resultant product should be homogeneous at temperatures from about 5° C. to about 49° C. and should exhibit a desirable viscosity.

SUMMARY OF THE INVENTION

The cleaning composition of the present invention comprises a liquid cleaning composition containing a binary solvent system comprised of cis/trans 2,6,6, trimethylbicyclo(3.1.1.)heptane—a saturated terpene hydrocarbon also known as Pinane—and a non-aqueous, polar, organic solvent having a solubility in water at 25° C. which is greater than about 20 percent by weight. Suitable solvents include the $C_1$–$C_4$ alkyl ethers of a compound selected from the group consisting of ethylene glycol, diethylene glycol and mono-, di- and tri-propylene glycol.

The foregoing binary solvent system in combination with a mixture of surfactants and also builder salts in an aqueous medium provides a synergistic cleaning action for removal of greasy soils from porous and nonporous hard surfaces.

The cleaning compositions of the present invention contain the following essential ingredients:

sulfated or sulfonated anionic detergent
nonionic detergent
saturated terpene
water-soluble solvent
builder salt
hydrotrope
water The use of saturated terpenes in the compositions according to the present invention provides a number of advantages over their unsaturated counterparts. Since saturated terpenes are essentially inert, they do not polymerize to resins through autooxidation, and thus cleaning compositions made with these compounds are inherently more stable than cleaning compositions made with unsaturated terpenes. Additionally, air oxidation of unsaturated terpenes can result in the formation of irritating hydroperoxides; whereas, saturated terpenes exhibit a significantly reduced potential for air oxidation. Also, saturated terpenes exhibit superior bleach stability characteristics due to their reduced oxidation potential.

The relationship between oxidation of magnesium peroxyphthalic acid and a saturated terpene—Pinane—or an unsaturated terpene—d-limonene—was studied as a function of bleach stability in liquid systems. With the concentration of active oxygen in the initial bleach concentration and its degration with time determined through $Na_2S_2O_3$ titration, Table I clearly shows the superiority of saturated terpenes with regard to bleach stability.

TABLE I

Relative Bleach Stability as a Function of Terpene Saturation

| | Intermediate Pinane (Saturated Terpene) | Limonene (Unsaturated Terpene) |
|---|---|---|
| | PERCENT ACTIVE OXYGEN | |
| Initial | 0.5 | 0.5 |
| +30 min | 0.095 | 0.059 |
| +1 Hour | 0.079 | 0.037 |
| +3 Hours | 0.062 | 0.022 |
| +5 Hours | 0.057 | 0.018 |

Liquid cleaners according to the present invention have been found to exhibit effective lathering and removal of soils, particularly grease soil, from glass, woodwork, vitreous, painted and enameled surfaces, as well as from metal surfaces such as aluminum ware and copper pan bottoms, with good polishing action and no scratching. The cleaners are also effective for removing soil from the hands and from vehicle tires, for removal of wax from waxed surfaces, and for a variety of other applications.

The cleaners of the present invention can be formulated to exhibit desirable characteristics with regard to both physical properties and performance in use. As to physical properties, the compositions may be formulated to be homogeneous, pourable, and free-flowing from the container as manufactured as well as after aging at various temperatures. For example, they may be formulated to exhibit a high degree of stability upon storage at normal room temperature of about 24° C. over a period of many months without any appreciable precipitation or formation of layers. Also, when subjected to elevated temperatures of about 38° C. or cooled to about 5° C., the liquid will remain in homogeneous form. As a result of this homogeneity, even when only very small quantities are dispensed, the components will be present in the correct proportions. Furthermore, the liquid may be packaged in any suitable container such as metal, plastic, or glass bottles, bags, cans or drums.

According to the present invention, the liquid hard surface cleaner comprises, by weight, from about 2% to 8% of a water-soluble synthetic anionic detergent, from about 0.25% to 4% of water-soluble ethyleneoxylated nonionic detergent, from about 2% to 15% of water-soluble builder salt, from about 1% to about 8% of Pinane, from about 1% to about 8% polar organic solvent having a water solubility at 25° C. greater than about 20% by weight, from about 1% to about 8% of $C_1$–$C_3$ alkyl substituted benzene sulfonate hydrotrope, and the remainder water. Optional ingredients can include up to 2% of $C_8$–$C_{18}$ fatty acid, up to 8% urea and up to a total of 5% of other additives on a weight basis.

DETAILED DESCRIPTION OF THE INVENTION

The synthetic anionic detergents (excluding true soaps) employed in the cleaners according to the present invention can be broadly described water-soluble salts, particularly alkali metal salts of organic sulfuric reaction products having in the molecular structure an alkyl radical containing from about 8 to about 22 carbon atoms and a water-solubilizing radical selected from sulfonic acid or sulfuric acid radicals, and mixtures thereof. Illustrative examples of water-soluble synthetic anionic detergents are sodium and potassium alkyl sulfates, especially those obtained by sulfating the $C_8$–$C_{18}$ alcohols produced by reducing the glycerides of tallow or coconut oil; sodium and potassium alkyl benzene sulfonates in which the alkyl group contains from about 8 to about 16 carbon atoms, especially those of the type described in U.S. Pat. No. 2,220,099 and No. 2,477,383; sodium alkyl glyceryl ether sulfonates especially those ethers of the $C_8$–$C_{18}$ alcohols derived from tallow and coconut oil; sodium $C_8$–$C_{18}$ fatty acid monoglyceride sulfates; sodium, potassium and ammonium salts of sulfuric acid esters of the reaction product of at least one $C_8$–$C_{18}$ alkanol and about one to twelve, preferably one to five, moles of ethylene oxide; sodium and ammonium salts of $C_8$–$C_{12}$ alkyl phenol ethylene oxide ether sulfate with about one to six units of ethylene oxide per molecule, such as ammonium nonyl phenol tetraethoxamer sulfate; sodium and ammonium salts of $C_{10}$–$C_{20}$ alkane sulfonates; sodium and potassium salts of $C_{12}$–$C_{21}$ alkene sulfonate; the reaction product of a $C_8$–$C_{18}$ fatty acid esterified with isethionic acid and neutralized with sodium hydroxide where, for example, the fatty acids are derived from coconut oil; and mixtures thereof.

The preferred water-soluble synthetic anionic detergents are the sodium, potassium, ammonium and substituted ammonium (such as mono, di, and triethanolamine) salts of $C_9$–$C_{15}$ alkyl benzene sulfonates, $C_{10}$–$C_{20}$ alkane sulfonates and $C_8$–$C_{18}$ alkyl ether polyethenoxy (1–5) sulfates. A particularly suitable alkylbenzene sulfonate contains 9 to 14 carbon atoms in the alkyl group in a straight chain with an alkyl distribution of 13–19% $C_9$, 15–25% $C_{10}$, 15–25% $C_{11}$, 15–25% $C_{12}$, 19% $C_{13}$, and 8% maximum of $C_{14}$. Another good alkylbenzene sulfonate is a linear alkyl benzene sulfonate having a high content of 3 (or higher) phenyl isomers and a correspondingly low content (well below 50%) of 2 (or lower) phenyl isomers; in other terminology the benzene ring is preferably attached in large part at the 3 or higher (e.g., 4, 5, 6 or 7) position of the alkyl group and the contents of isomers at which the benzene ring is attached at the 2 or 1 position is correspondingly low. The latter sulfonates are described in U.S. Pat. No. 3,320,174.

Nonionic detergents used in the cleaners according to the present invention can be broadly described as water-soluble or water-dispersible compounds produced by the condensation of hydrophilic ethylene oxide groups with an organic hydrophobic aliphatic or alkyl aromatic compound having a terminal hydroxy group. Such detergents are prepared readily by condensing the hydrophobic organic compound with ethylene oxide or with the polyhydration product thereof, polyethylene glycol. Further, the length of the polyethenoxy chain can be adjusted to achieve the desired balance between the hydrophobic and hydrophilic elements.

The satisfactory nonionic detergents include the condensation products of a higher alkanol containing about 8 to 18 carbon atoms in a straight- or branched-chain configuration condensed with about 5 to 30 moles of ethylene oxide. Preferred examples of these detergents are the condensates of $C_9$–$C_{11}$ alkanol with 2.5 moles of ethylene oxide, condensates of $C_{12}$–$C_{13}$ alkanol with 6.5 moles of ethylene oxide and condensates of $C_{10}$–$C_{12}$ alkanol with about 60% by weight of ethylene oxide.

Other satisfactory nonionic detergents are the polyethylene oxide condensates of one mole of alkyl phenol containing from about 6 to 15 carbon atoms in a straight- or branched-chain configuration with about 5 to 30 moles of ethylene oxide, with ethylene oxide content being from about 40% to about 60% by weight of the condensate.

The saturated terpene hydrocarbon employed in the compositions of the present invention is cis/trans 2,6,6 trimethylbicyclo(3.1.1)heptane which is sold by Glidden as intermediate Pinane. While this compound has good solvent properties, it has limited solubility in water. Thus, preparation of homogeneous compositions using Pinane presents problems for the formulator.

The polar organic solvents employed in the present invention in combination with Pinane have a solubility in water at 25° C. of at least about 20% by weight and thus are water miscible or water soluble. Suitable nonaqueous solvents may be described generally as $C_1$–$C_4$ alkyl ethers of a compound selected from the group consisting of ethylene glycol, diethylene glycol and mono-, di or tripropylene glycol. Specific examples of such nonaqueous, polar, organic solvents include ethylene glycol monomethyl ether, ethylene glycol monobutyl ether, diethylene glycol monoethyl ether, tripropylene glycol mono-methyl ether and dipropylene glycol monomethyl ether, with ethylene glycol monobutyl ether, tripropylene glycol monomethyl ether and dipropylene glycol monomethyl ether being particularly preferred. An essential characteristic of these solvents is their solubility in water because this property is essential to achieve effective solvent action in conjunction with Pinane and at the same time maintain monogeneity.

Another essential component in the compositions of this invention is a water soluble builder salt or mixture of builder salts. Such salts are included to enhance the cleaning action of the organic surface action agents—the anionic and nonionic detergents—and to maintain the pH of the all-purpose liquid composition in the alkaline range. Such salts are water-soluble and may be either organic or inorganic compounds capable of sequestering or precipitating calcium ions. Generally the builder salt will be a water-soluble sodium, potassium or ammonium salt of carbonate, bicarbonate, polyphosphate, polycarboxylate or aminopolycarboxylate. Examples of suitable builder salts include sodium carbonate, sodium bicarbonate, potassium tripolyphosphate, potassium pyrophosphate, sodium citrate dihydrate, trisodium nitrilotriacetate, tetrasodium ethylenediamine tetraacetate and mixtures thereof. A preferred builder is the mixture of sodium citrate dihydrate and sodium carbonate.

A further essential component of the claimed all-purpose liquid compositions is a $C_1$–$C_3$ alkyl substituted benzene sulfonate hydrotrope salt. Such salts are included to solubilize the other essential ingredients in the aqueous medium and to control the viscosity of the compositions with the proportions being controlled so that said component does not result either increased residue or reduced shine on surfaces cleaned with the all-purpose liquid. Examples of suitable hydrotropic salts are sodium, potassium and ammonium salts of xylene sulfonate, toluene sulfonate and cumene or isopropylbenzene sulfonate. The hydrotrope or mixture of hydrotropic salts generally is present in an amount of 0.5% to 8%, preferably 1% to 6%, by weight of the total composition.

The final essential component of the inventive compositions is water and this component usually represents the balance of said compositions except for the presence of optional ingredients.

The proportions of the various essential ingredients in the inventive compositions are integrated in order to achieve the desired homogeneity and performance properties. Generally, the proportion of anionic detergent employed will be from 2% to 8%, preferably from 3% to 6%, by weight. Also, the proportion of nonionic detergent will be from about 0.25% to 4%, preferably from 0.5% to 2% by weight. Further, the proportion of the nonionic detergent is controlled relative to the anionic sulfonate or sulfate detergent so that the weight ratios will be from 1:32 to 2:1, preferably from 1:6 to 1:2. Generally, the proportion of the saturated terpene will be from about 1% to 8%, preferably from about 1.5% to 4%, by weight. Similarly, the non-aqueous, polar, organic solvent with the specified water solubility will be from about 1% to 8%, preferably 1.5% to 4%, by weight. Usually, the builder salt will be from 2% to 15%, preferably from 4% to 10%, by weight; and the alkyl substituted benzene hydrotropic salt will be from about 0.5% to 8%, preferably, from about 1% to 5% by weight. The weight ratio of builder to detergent—the sum of the anionic sulfonated detergent and the nonionic detergent—will be controlled in the range of 1:6 to 7:1, preferably, from 0.5:1 to 2.5:1. The balance of the composition will be water in the absence of any optional ingredients. Naturally, the proportion of water will be reduced by the proportion of any optional ingredients which may be present.

Optionally, up to 2% by weight of a sodium, potassium or ammonium salt of a $C_8$–$C_{18}$ alkanoic acid and up to 8% by weight of urea may be included in the all-purpose liquid compositions. The alkanoic acid salt provides desirable foaming properties, particularly rapid foam collapse when present; and the preferred proportion thereof is 0.5% to 1.5% by weight. When the alkanoic acid salt is present, such salt is included as a detergent in determining the weight ratio of builder salt to the total detergent. On the other hand, urea provides improved low temperature stability by reducing the clear point of the all-purpose liquid. The preferred concentration of urea is 1% to 6% by weight.

Another optional component is ammonia which is usually added as aqueous ammonia or ammonium hydroxide. This ingredient provides a desirable ammonia odor in the product and appears to enhance the removal of grease soil. When present, the concentration of ammonia in the all-purpose liquid usually ranges from about 0.1% to 0.5%, preferably 0.15% to 0.25%, by weight.

The all-purpose liquid according to this invention may, if desired, also contain other components either to provide an additional effect or to make the product more attractive to the consumer. The following are mentioned by way of example. Up to 1% by weight of perfumes, colors or dyes, opacifiers, bactericides and tarnish inhibitors such as benzotriazole may be added. Further, up to about 2% by weight of an organic solvent such as ethanol, ethylene glycol or propylene glycol may be included for control of viscosity or special solvent effects. Additionally, supplemental water-soluble, inorganic salts, preferably non-phosphate salts, such as sodium silicate, sodium sulfate, sodium chloride, etc. may be present in amounts up to about 3% by weight to provide enhanced building action or for pH control.

In final form, the all-purpose liquids are clear and homogeneous and exhibit stability at reduced and increased temperatures. More specifically, such compositions exhibit clear points in the range of 5° C. to 50° C. and generally do not cloud below about 65° C. when heated. Such compositions exhibit a pH in the range of 7.5 to 11.5, preferably 9 to 11. The liquids are readily pourable and exhibit a viscosity in the range of 5 to 60 centipoises (cps.) as measured at 24° C. with a Brookfield RVT Viscometer using a #1 spindle rotating at 20 RPM. Preferably, the viscosity is maintained in the range of 10 to 30 cps.

Typically, the inventive compositions are manufactured in an agitated mixing vessel optionally equipped with a heating and/or cooling jacket. Generally, the temperature of the mixture will be maintained in the range of 15° C. to 38° C. during manufacture. While the order in which the individual ingredients are added can be varied, best results are obtained by adding the hydrotropic salt to the water with mild agitation followed by the addition of the anionic and nonionic detergents. Next, the Pinane and nonaqueous solvent are added with moderate agitation to form a homogeneous mixture. Thereafter, the builder salts(s), usually in particulate form, are added with moderate agitation which is continued until said salts are dissolved. Usually, color and perfume are the final ingredients added with agitation to form a homogeneous all-purpose liquid cleaning composition.

The following examples illustrate liquid cleaning compositions of the described invention. Unless otherwise specified, all percentages are by weight. The exemplified compositions are illustrative only and do not limit the scope of the invention.

| | EXAMPLES I-V | | | | |
|---|---|---|---|---|---|
| | I | II | III | IV | V |
| Sodium cumene sulfonate | 1.80 | 2.25 | 1.80 | 1.80 | 1.80 |
| LAS[a] | 3.65 | 3.65 | 3.65 | 3.65 | 3.65 |
| Neodol 23-6.5[b] | 0.50 | 0.25 | 1.00 | 0.50 | |
| Neodol 91-2.5[c] | | 0.25 | | 0.50 | 0.50 |
| Pinane[d] | 1.80 | 1.80 | 1.80 | 1.80 | 1.80 |
| Tripropylene-glycol methyl ether | 1.80 | 1.80 | 1.80 | 1.80 | 1.80 |
| Fragrance | 0.30 | 0.30 | 0.30 | 0.30 | 0.30 |
| Color | 0.60 | 0.60 | 0.60 | 0.60 | 0.60 |
| Sodium citrate dihydrate | 3.00 | 3.00 | 3.00 | 3.00 | 3.00 |
| Sodium carbonate | 3.00 | 3.00 | 3.00 | 3.00 | 3.00 |
| Water | q.s | q.s | q.s | q.s | q.s |
| Total | 100.0 | 100.0 | 100.0 | 100.0 | 100.0 |

[a]Sodium linear dodecylbenzene sulfonate
[b]Condensation product of $C_{12}$-$C_{13}$ alkanol with 6.5 moles of ethylene oxide
[c]Condensation produce of $C_9$-$C_{11}$ alkanol with 2.5 moles of ethylene oxide
[d]cis/trans 2,6,6 Trimethylbicyclo (3.1.1) heptane
q.s. - quantity sufficient The compositions of Examples I–V are clear liquids having a viscosity of 15–20 centipoises at 24° C.

EXAMPLE VI

Example I is repeated using 3% by weight of sodium carbonate in place of sodium citrate dihydrate to produce a clear, stable formulation having equivalent cleaning performance.

EXAMPLE VII

Example II is repeated with the exception that 6% by weight of tetrapotassium pyrophosphate is substituted for the mixture of 3% sodium citrate dihydrate and 3% of sodium carbonate. The resultant composition is a clear liquid at room temperature which has good grease soil removal properties.

EXAMPLE VIII

Example III is repeated using 3% by weight of trisodium nitrilotriacetate in place of sodium citrate dihydrate to provide an effective cleaning formulation.

EXAMPLE IX

The advantages of the binary solvent systems of the present invention are illustrated in Table II which sets forth the grease soil removal results achieved with a composition of the present invention—Composition A—and similar compositions containing only a single solvent—Composition B—or a mixture of a terpene with a second solvent—Compositions C and D. In the particular test, white formica tiles (9 inches by 18 inches) are soiled with an extracted kitchen grease having a brown color by applying a 1.5 inch strip of said soil to each tile. Each soiled tile is then aged for one week at 24° C. before being washed using a Gardner abrading apparatus. In such apparatus a piece of mohair measuring 3.81 cm×9.4 cm affixed to a block is contacted with said soiled tile as it is reciprocated through a 1.5% weight concentration of the test product in water maintained at about 38° C. Reciprocation is continued until a discernible difference is noted in soil removal, at which time the reciprocation ceases. The amount of soil removed is based upon a reflectance reading using a Photovolt Model 670 Reflectometer, with the % removal being determined by the following formula:

$$\% \text{ Removal} = \frac{Rd \text{ of cleaned tile} - Rd \text{ of soiled tile}}{Rd \text{ of unsoiled tile} - Rd \text{ of soiled tile}} \times 100$$

Two different products are compared with each other in this test in order to minimize differences due to lack of complete reproducibility in preparing soiled tiles. The formulas of the test compositions follow:

| | A | B | C | D |
|---|---|---|---|---|
| LAS | 3.65 | 3.65 | 3.65 | 3.65 |
| Sodium cumene sulfonate | 1.8 | 1.8 | 1.8 | 1.8 |
| Condensate of $C_{10}$-$C_{12}$ alkanol with ethylene oxide (60% by weight) | 0.6 | 0.6 | 0.6 | 0.6 |
| Pinane | 2.0 | — | — | — |
| Limonene | — | — | 2.0 | 2.0 |
| Benzyl alcohol | — | — | 1.6 | — |
| Ethylene glycol monobutyl ether | 1.6 | 3.5 | — | 1.6 |
| Fragrance | 0.3 | 0.3 | 0.3 | 0.3 |
| Color | 0.6 | 0.6 | 0.6 | 0.6 |
| Sodium citrate dihydrate | 3.3 | 3.3 | 3.3 | 3.3 |
| Sodium carbonate | 3.0 | 3.0 | 3.0 | 3.0 |
| Water | q.s. | q.s. | q.s. | q.s. |
| Total | 100.0 | 100.0 | 100.0 | 100.0 |

The percent soil removal of the foregoing formulations is set forth in Table II below:

TABLE II

| Composition | Percent Soil Removal |
|---|---|
| A | 52 |
| B | 19 |
| C | 19 |
| D | 48 |

The foregoing tabulation clearly shows that Composition A corresponding to the present invention was far superior to Composition B which contained only water soluble solvent and to Composition C containing a mixture of terpene and a second solvent of limited water solubility. In addition, Composition A was superior to Composition D containing a mixture of terpene and a second water-soluble solvent.

It is understood that the foregoing detailed description is given merely by way of illustration and that variation may be made therein without departing from the spirit of the invention. The "Abstract" given above is merely for the convenience of technical searchers and is not to be given any weight with respect to the scope of the invention.

What is claimed is:

1. A clear liquid hard surface cleaner consisting essentially of, by weight, from 2% to 8% of a water-soluble, synthetic anionic sulfated or sulfonated detergent salt having an alkyl group of 8 to 22 carbon atoms in the molecule; from 0.25% to 4% of a water-soluble ethyleneoxylated nonionic detergent; from 1% to 8% cis/trans 2,6,6 trimethylbicyclo(3.1.1)heptane; from 1% to 8% of a nonaqueous, polar, organic solvent having water solubility at 25° C. of at least 20% by weight selected from the group consisting of $C_1$–$C_4$ alkyl ethers of ethylene glycol or diethylene glycol or mono-, di- or tripropylene glycol, from 2% to 15% of a water-soluble organic or inorganic alkaline builder salt; from 0.5% to 8% of a $C_1$–$C_3$ alkyl-substituted benzene sulfonate hydrotrope salt; and the balance primarily water.

2. A cleaner according to claim 1 wherein said nonaqueous solvent is said $C_1$–$C_4$ alkylether of mono-, di- or tripropylene glycol.

3. A cleaner according to claim 2 wherein said nonaqueous solvent is tripropylene glycol methyl ether.

4. A cleaner according to claim 1 wherein said nonaqueous solvent is ethylene glycol monobutyl ether.

5. A cleaner according to claim 3 wherein said anionic detergent is a $C_8$–$C_{16}$ alkylbenzene sulfonate, said builder is a mixture of sodium citrate dihydrate and sodium bicarbonate and said hydrotropic salt is sodium isopropylbenzene sulfonate.

6. A cleaner according to claim 4 wherein said anionic detergent is a $C_8$–$C_{16}$ alkylbenzene sulfonate, said builder is a mixture of sodium citrate dihydrate and sodium bicarbonate and said hydrotropic salt is sodium isopropylbenzene sulfonate.

7. A cleaner according to claim 1 wherein said anionic detergent is selected from the group consisting of $C_9$–$C_{14}$ alkylbenzene sulfonate and $C_{10}$–$C_{20}$ alkane sulfonate and is present in an amount of 3% to 7% by weight; said nonionic detergent is a condensate of a hydrophobic alkanol having from 9 to 13 carbon atoms and ethylene oxide, with the weight proportion of ethylene oxide being from about 40% to about 60%, which is present in an amount of from 0.5% to 2% by weight; said non-aqueous solvent is present in an amount of from 1.5% to 4% by weight; said heptane is present in an amount of 1.5% to 4% by weight; said builder salt is present in an amount of about 4% to 10% by weight and said hydrotropic salt is sodium isopropylbenzene sulfonate or sodium xylene sulfonate which is present in an amount of 1% to 6% by weight.

8. A cleaner according to claim 7 wherein said nonaqueous solvent is said $C_1$–$C_4$ alkylether of mono-, di- or tripropylene glycol.

9. A cleaner according to claim 8 wherein said nonaqueous solvent is tripropylene glycol methyl ether.

10. A cleaner according to claim 7 wherein said nonaqueous solvent is ethylene glycol monobutyl ether.

11. A cleaner according to claim 9 wherein said anionic detergent is a $C_8$–$C_{16}$ alkylbenzene sulfonate, said builder is a mixture of sodium citrate dihydrate and sodium bicarbonate and said hydrotropic salt is sodium isopropylbenzene sulfonate.

12. A cleaner according to claim 10 wherein said anionic detergent is a $C_8$–$C_{16}$ alkylbenzene sulfonate, said builder is a mixture of sodium citrate dihydrate and sodium bicarbonate and said hydrotropic salt is sodium isopropylbenzene sulfonate.

* * * * *